US007458115B2

(12) United States Patent
Chen et al.

(10) Patent No.: US 7,458,115 B2
(45) Date of Patent: Dec. 2, 2008

(54) FOLDABLE BABY CRIB

(75) Inventors: Shun-Min Chen, Taipei (TW); Jian-Qun Li, Taipei (TW); Dao-Chang Li, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 0 days.

(21) Appl. No.: 11/819,644

(22) Filed: Jun. 28, 2007

(65) Prior Publication Data

US 2008/0034498 A1 Feb. 14, 2008

(30) Foreign Application Priority Data

Aug. 10, 2006 (CN) ..... 2006 2 0129739

(51) Int. Cl.
*A47D 7/00* (2006.01)
*A47D 13/06* (2006.01)

(52) U.S. Cl. ..... 5/99.1; 5/93.1

(58) Field of Classification Search ..... 5/99.1, 5/98.1, 93.1; 403/102
See application file for complete search history.

(56) References Cited

U.S. PATENT DOCUMENTS 2,908,021 A * 10/1959 Fulton ..... 5/99.1
2,922,169 A * 1/1960 Werner ..... 5/98.1
2,989,318 A * 6/1961 Schenkman ..... 280/643
2,991,486 A * 7/1961 Hamilton ..... 5/98.1
3,040,341 A * 6/1962 Hesketh et al. ..... 5/99.1
RE25,195 E * 7/1962 Hamilton ..... 5/98.1
3,063,065 A * 11/1962 Shaw ..... 5/99.1
3,092,847 A * 6/1963 De Puy ..... 5/99.1
3,095,583 A * 7/1963 Golub et al. ..... 5/99.1
3,119,124 A * 1/1964 Krauss ..... 5/99.1
3,158,876 A * 12/1964 Gottlieb ..... 5/99.1
3,206,772 A * 9/1965 Sarasin ..... 5/99.1
3,206,773 A * 9/1965 Sarasin ..... 5/99.1
3,233,254 A * 2/1966 Golub et al. ..... 5/99.1
3,309,718 A * 3/1967 Sarasin ..... 5/99.1
3,474,472 A 10/1969 Hamilton, II
4,069,524 A * 1/1978 Carlo ..... 5/99.1
4,070,716 A * 1/1978 Satt et al. ..... 5/99.1
4,304,017 A * 12/1981 Mortimer ..... 5/99.1
4,357,735 A * 11/1982 Saint et al. ..... 16/224

(Continued)

FOREIGN PATENT DOCUMENTS

EP 0295761 B1 12/1988

(Continued)

*Primary Examiner*—Robert G Santos
(74) *Attorney, Agent, or Firm*—Pillsbury Winthrop Shaw Pittman LLP

(57) ABSTRACT

A foldable baby crib includes a bottom frame unit, lateral frame units, and upper and lower pivot connectors. Each lateral frame unit includes a pivot connection seat, a pair of support rods, each having a top rod end pivoted to the pivot connection seat, and a pair of top rods, each having an inner rod end pivoted to the pivot connection seat. The upper pivot connectors interconnect pivotally outer rod ends of the top rods of adjacent lateral frame units. The lower pivot connectors interconnect pivotally lower rod ends of the support rods of adjacent lateral frame units. The bottom frame unit is connected to the lower pivot connectors and is operable to convert the foldable baby crib from an expanded state to a folded state, where the lateral frame units are collapsed.

15 Claims, 14 Drawing Sheets

U.S. PATENT DOCUMENTS

| | | | | |
|---|---|---|---|---|
| 4,455,697 | A * | 6/1984 | Rovida | 5/99.1 |
| 4,499,619 | A * | 2/1985 | Kassai | 5/99.1 |
| 4,573,224 | A | 3/1986 | Saint | |
| 4,635,305 | A * | 1/1987 | Wyss | 5/99.1 |
| 4,683,600 | A * | 8/1987 | Beger | 5/99.1 |
| 4,710,049 | A * | 12/1987 | Chang | 403/23 |
| 5,193,234 | A * | 3/1993 | Joaquin | 5/99.1 |
| 5,778,465 | A * | 7/1998 | Myers | 5/99.1 |
| 6,588,033 | B1 * | 7/2003 | Welsh et al. | 5/99.1 |
| 6,634,038 | B2 * | 10/2003 | Hsia | 5/95 |
| 6,675,413 | B2 * | 1/2004 | Hsia | 5/98.1 |
| 6,907,626 | B1 * | 6/2005 | Welsh et al. | 5/99.1 |
| 7,293,304 | B2 * | 11/2007 | Chen et al. | 5/99.1 |
| 2003/0066129 | A1 * | 4/2003 | Hsia | 5/99.1 |
| 2005/0166316 | A1 | 8/2005 | Gehr et al. | |
| 2007/0011809 | A1 * | 1/2007 | Chen et al. | 5/99.1 |
| 2007/0277308 | A1 * | 12/2007 | Chen et al. | 5/99.1 |
| 2008/0000023 | A1 * | 1/2008 | Chen et al. | 5/99.1 |
| 2008/0034498 | A1 * | 2/2008 | Chen et al. | 5/99.1 |

FOREIGN PATENT DOCUMENTS

| | | | |
|---|---|---|---|
| GB | 2086218 | A * | 5/1982 |
| GB | 2125281 | A * | 3/1984 |

* cited by examiner

FOLDABLE BABY CRIB

CROSS-REFERENCE TO RELATED APPLICATION

This application claims priority of Chinese application no. 200620129739.3, filed on Aug. 10, 2006.

BACKGROUND OF THE INVENTION

1. Field of the Invention

The invention relates to a baby crib, more particularly to a foldable baby crib.

2. Description of the Related Art

Foldable baby cribs are known in the art. For example, in U.S. Pat. Nos. 3,474,472 and 4,573,224, there are disclosed foldable baby cribs that can be collapsed by moving frame components toward each other to fold the baby crib in a single dimension. Furthermore, while U.S. Patent Application Publication No. 2005/0166316 A1 and EP 0295761 B1 disclose foldable baby cribs having components that can be collapsed toward a center of the baby crib, more than one folding action and/or force-exerting point are needed. There is thus a need to provide a foldable baby crib that can be conveniently folded and that occupies a relatively small amount of space when folded.

SUMMARY OF THE INVENTION

Therefore, the object of the present invention is to provide a foldable baby crib that can be folded via a single-handed folding action and that occupies a relatively small amount of space when folded.

According to one aspect of the present invention, there is provided a foldable baby crib that comprises a bottom frame unit, a plurality of lateral frame units, a plurality of upper pivot connectors, and a plurality of lower pivot connectors.

Each of the lateral frame units includes: a pivot connection seat; a pair of support rods, each of which has a top rod end pivoted to the pivot connection seat, and an opposite lower rod end; and a pair of top rods, each of which has an inner rod end pivoted to the pivot connection seat, and an opposite outer rod end.

Each of the upper pivot connectors interconnects pivotally the outer rod ends of the top rods of an adjacent pair of the lateral frame units.

Each of the lower pivot connectors interconnects pivotally the lower rod ends of the support rods of an adjacent pair of the lateral frame units, and is connected pivotally to the bottom frame unit.

The bottom frame unit is operable to convert the foldable baby crib between an expanded state, where the bottom frame unit and the lateral frame units cooperate to define a crib space, and a folded state, where the bottom frame unit and the lateral frame units are collapsed.

According to another aspect of the present invention, there is provided a foldable baby crib that comprises a plurality of lateral frame units, a plurality of upper pivot connectors, a plurality of lower pivot connectors, and an actuator.

Each of the lateral frame units includes: a pivot connection seat; a pair of support rods, each of which has a top rod end pivoted to the pivot connection seat, and an opposite lower rod end; a pair of top rods, each of which has an inner rod end pivoted to the pivot connection seat, and an opposite outer rod end; a rod connector; and a pair of bottom rods, each of which has an inner rod end and an opposite outer rod end. The inner rod ends of the bottom rods are pivoted to the rod connector.

Each of the upper pivot connectors interconnects pivotally the outer rod ends of the top rods of an adjacent pair of the lateral frame units.

Each of the lower pivot connectors interconnects pivotally the lower rod ends of the support rods of an adjacent pair of the lateral frame units, and the outer rod ends of the bottom rods of the adjacent pair of the lateral frame units.

The actuator includes a plurality of connecting sections, each of which has an inner end and an opposite outer end connected to the rod connector of a respective one of the lateral frame units.

The actuator is operable by pulling at the inner ends of the connecting sections to convert the foldable baby crib from an expanded state, where the lateral frame units cooperate to define a crib space, to a folded state, where the lateral frame units are collapsed toward each other.

According to yet another aspect of the invention, a baby crib is convertible between an expanded state and a folded state, and comprises a plurality of lateral frame units, each forming a side of the baby crib when the baby crib is in the expanded state. Each lateral frame unit includes a pivot connection seat, a pair of support rods, each of which has a top rod end pivoted to the pivot connection seat, and an opposite lower rod end, and a pair of top rods, each of which has an inner rod end pivoted to the pivot connection seat and an opposite outer rod end. The support rods of each lateral frame unit form an inverted V-shaped configuration when the baby crib is in the expanded state. The lower rod ends of the support rods of each lateral frame unit are close to each other, and the top rods of each lateral frame unit are pivoted relative to the pivot connection seat when the baby crib is converted from the expanded state to the folded state.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
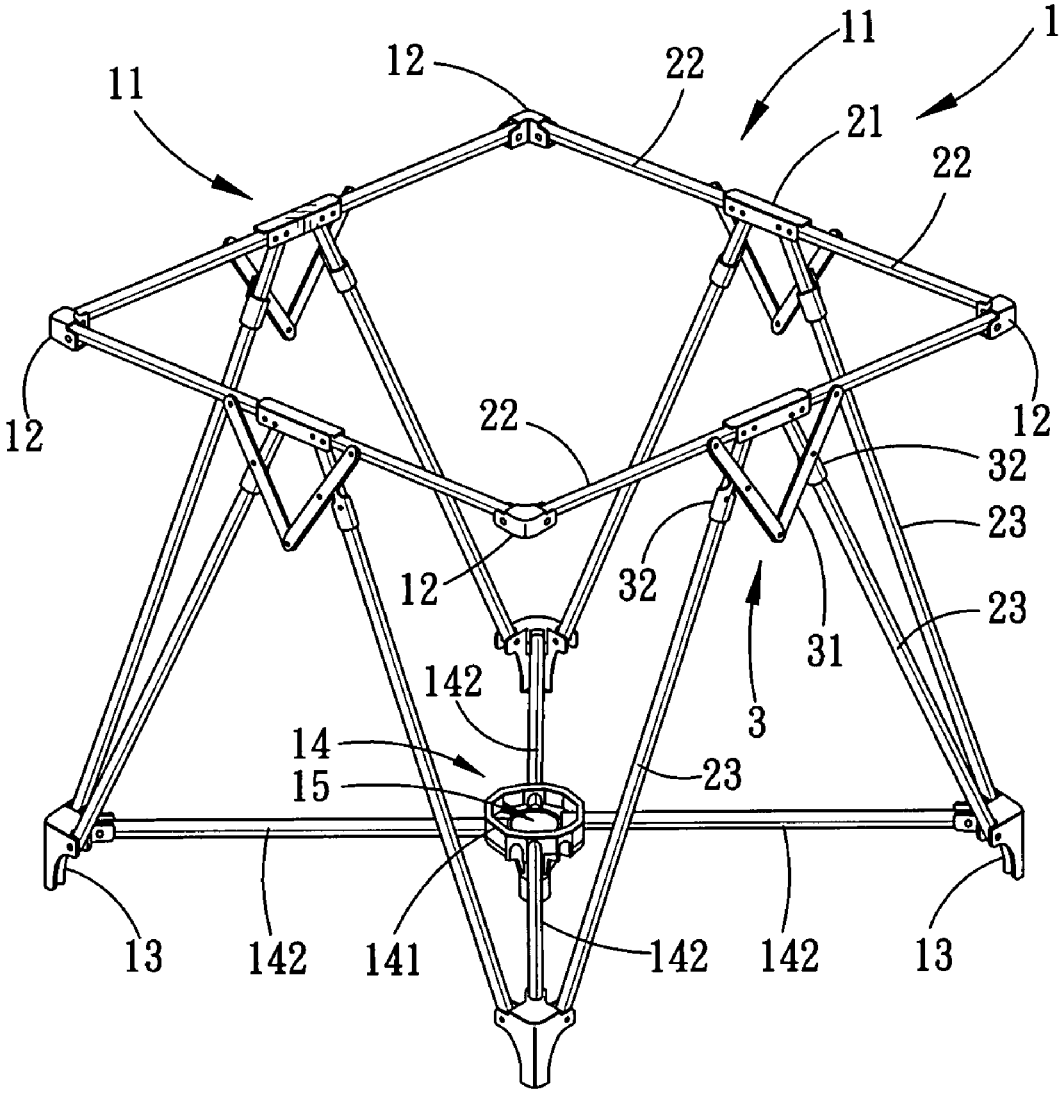
FIG. 1 is a perspective view of the first preferred embodiment of a foldable baby crib according to the present invention.

Referring to FIGS. 1 to 5, the first preferred embodiment of a foldable baby crib 1 according to the is present invention, which has a square-shaped configuration, is shown to include four lateral frame units 11, four upper pivot connectors 12, four lower pivot connectors 13, and a bottom frame unit 14. The foldable baby crib 1 is convertible between an expanded state (see FIG. 1), where the lateral frame units 11 and the bottom frame unit 14 cooperate to define a crib space, and a folded state (see FIG. 5), where the lateral frame units 11 are collapsed toward each other, in a manner that will be described in further detail hereinafter.

Figure 2:
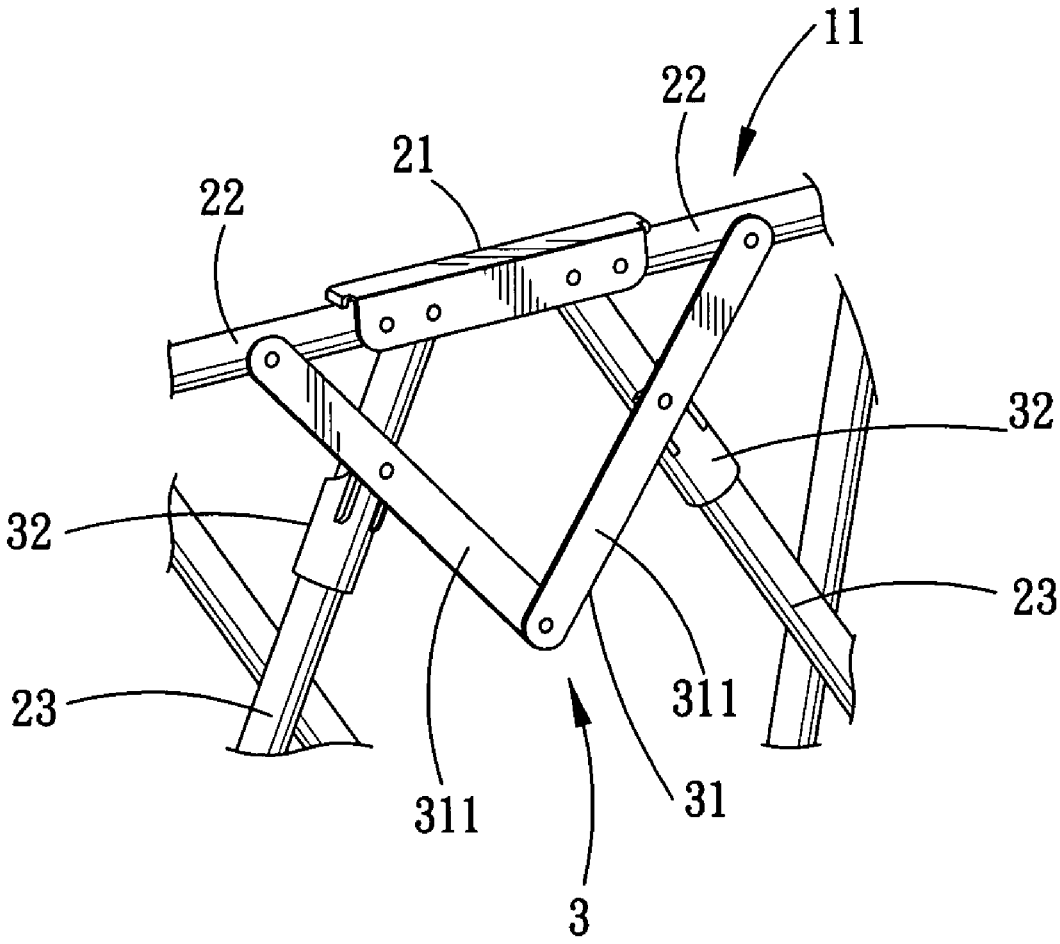
FIG. 2 is a fragmentary enlarged perspective view of a lateral frame unit of the first preferred embodiment.

Each of the lateral frame units 11 includes an elongate pivot connection seat 21, a pair of support rods 23, a pair of top rods 22, and a folding member 3. Each of the support rods 23 has a top rod end pivoted to the pivot connection seat 21, and an opposite lower rod end. Each of the top rods 22 has an inner rod end and an opposite outer rod end. As best shown in FIG. 2, the inner rod ends of the top rods 22 are pivoted to the pivot connection seat 21 at outer sides of the support rods 23, respectively. The folding member 3 includes a coupling part 31 pivoted to the top rods 22, and a pair of movable parts 32, each of which is connected pivotally to the coupling part 31 and is mounted slidingly on a respective one of the support rods 23. In this embodiment, the coupling part 31 includes a pair of elongate coupling links 311, each of which has first and second link ends. The second link ends of the coupling links 311 are pivoted to each other. The first link ends of the coupling links 311 are connected pivotally and respectively to the top rods 22 proximate to the pivot connection seat 21. In this embodiment, each of the movable parts 32 is pivoted to a respective one of the coupling links 311 between the first and second link ends of the same. Moreover, each of the movable parts 32 is tubular and is sleeved slidingly on the respective one of the support rods 23.

Each of the upper pivot connectors 12 interconnects pivotally the outer rod ends of the top rods 22 of an adjacent pair of the lateral frame units 11.

Each of the lower pivot connectors 13 interconnects pivotally the lower rod ends of the support rods 23 of an adjacent pair of the lateral frame units 11.

The bottom frame unit 14 includes a hub 141, and four connecting sections 142 in the form of rods. Each connecting section 142 has an inner end connected pivotally to the hub 141, and an opposite outer end. Each of the lower pivot connectors 13 is further connected pivotally to the outer end of a respective one of the connecting sections 142.

As best shown in FIGS. 1 and 2, when the foldable baby crib 1 is disposed in the expanded state, the connecting sections 142 radiate from the hub 141, the top rods 22 of each lateral frame unit 11 are aligned with the respective pivot connection seat 21 such that the top rods 22 of the lateral frame units 11 cooperate to form a square-shaped looped frame, and the support rods 23 of each lateral frame unit 11 form an inverted V-shaped configuration. The connecting sections 142 and the lateral frame units 11 cooperate to define the crib space at this time. In particular, the lateral frame units 11 form four sides of the expanded baby crib 1, the upper pivot connectors 12 are located at four upper corners of the expanded baby crib 1, and the lower pivot connectors 13 are located at four lower corners of the expanded baby crib 1.

Figure 3:
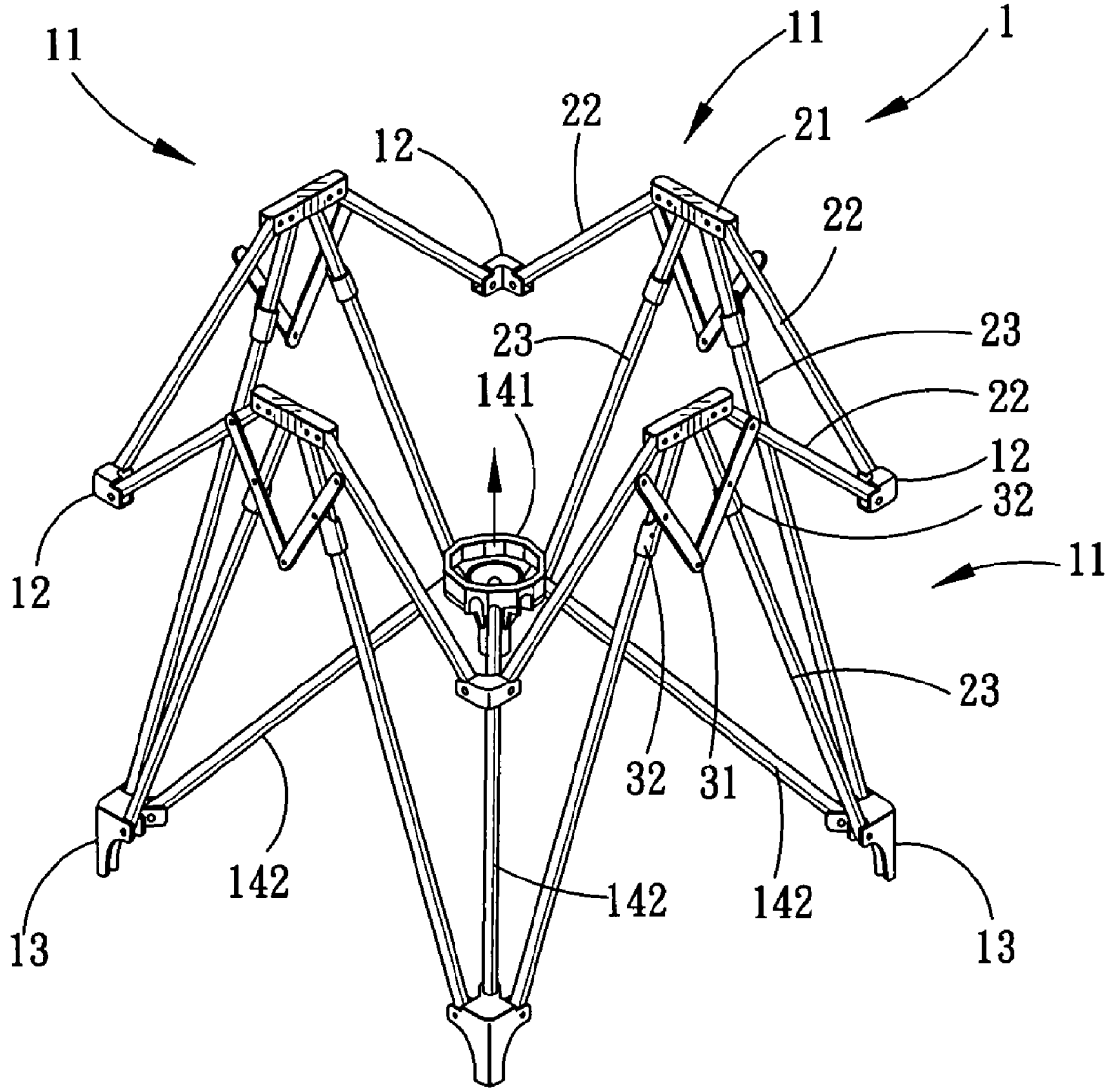
FIG. 3 is a perspective view to illustrate how the first preferred embodiment is folded.

Referring to FIGS. 1 and 3, to convert the baby crib 1 to the folded state, the hub 141 is lifted upward, thereby moving the inner ends of the connecting sections 142 upward, and moving the outer ends of the connecting sections 142, the lower pivot connectors 13 and the lower rod ends of the support rods 23 radially toward the hub 141. As the distance between adjacent ones of the lower pivot connectors 13 decreases, the angle between the support rods 23 connected to the same pivot connection seat 21 is reduced, thereby resulting in downward sliding movement of the movable parts 32 on the support rods 23 and in downward folding movement of the top rods 22 of the lateral frame units 11 relative to the respective pivot connection seat 21 via the coupling links 311. Therefore, the baby crib 1 can be converted to the folded state by folding the bottom frame unit 14 and without exerting force on the top rods 22.

Figure 4:
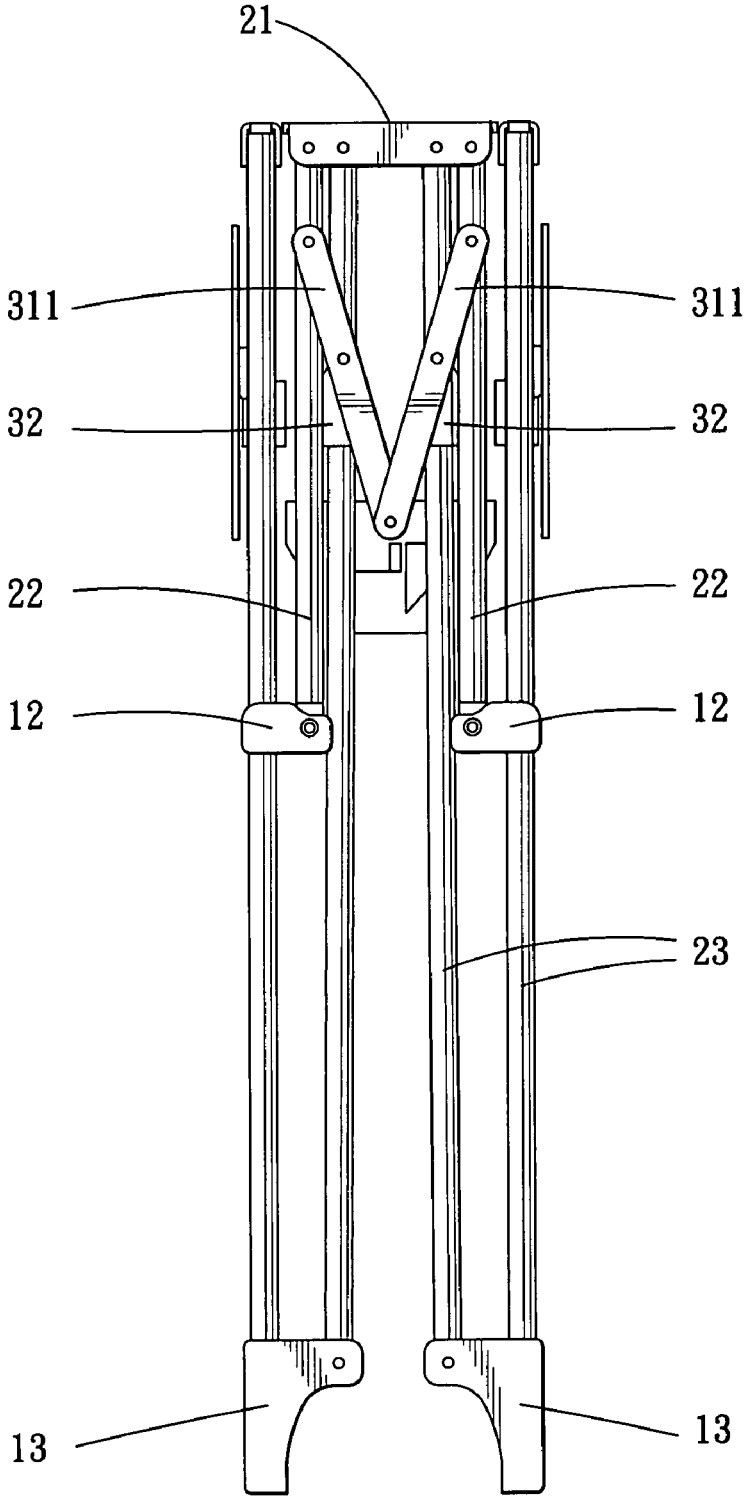
FIG. 4 is a schematic side view to illustrate the first preferred embodiment in a folded state.
Figure 5:
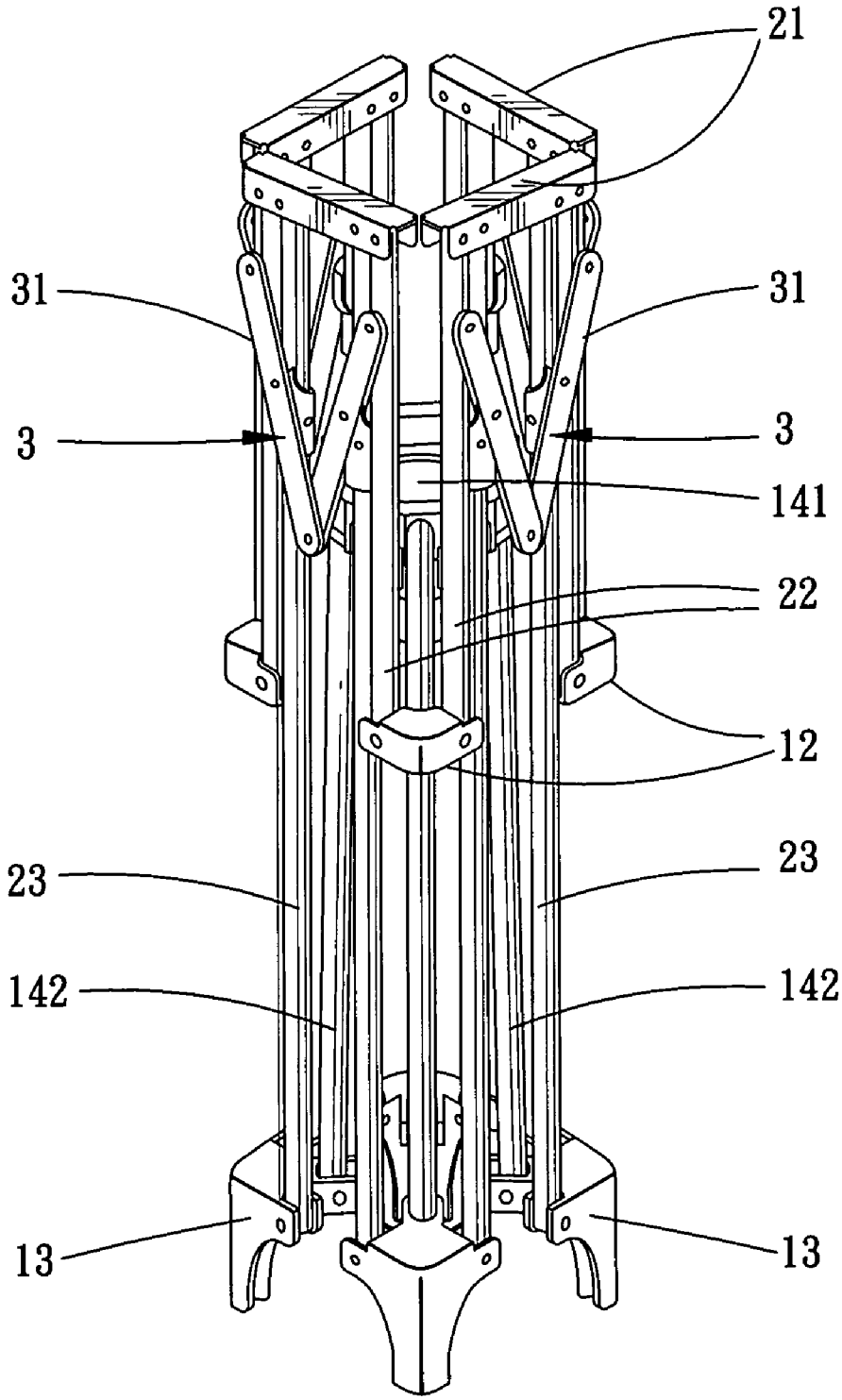
FIG. 5 is a perspective view of the first preferred embodiment in the folded state.

As shown in FIGS. 3 to 5, the top rods 22, the support rods 23, and the connecting sections 142 are parallel to each other and are disposed close to each other when the baby crib 1 is disposed in the folded state. In the folded state, the baby crib 1 has a square-shaped column configuration, and the coupling links 311 are disposed under the pivot connection seats 21.

Referring back to FIG. 3, to convert the baby crib 1 from the folded state back to the expanded state, the hub 141 is pressed downward such that the inner ends of the connecting sections 142 move downward, thereby moving the outer ends of the connecting sections 142, the lower pivot connectors 13, and the lower rod ends of the support rods 23 radially outward relative to the hub 141. In this embodiment, unfolding movement of the support rods 23 is transmitted simultaneously to the top rods 22 by the coupling links 311 such that the coupling links 311 further provide a function to help the top rods 22 unfold when converting the baby crib 11 to the expanded state.

Preferably, the hub 141 of the bottom frame unit 14 is provided with a locking mechanism 15 for locking the connecting sections 142 to the hub 141 when the baby crib 1 is in the expanded state. Thus, when it is desired to fold the baby crib 1, a switch (not shown) of the locking mechanism 15 is operated to unlock the connecting sections 142 from the hub 141 and permit upward lifting movement of the hub 141 for converting the baby crib 1 to the folded state.

Figure 6:
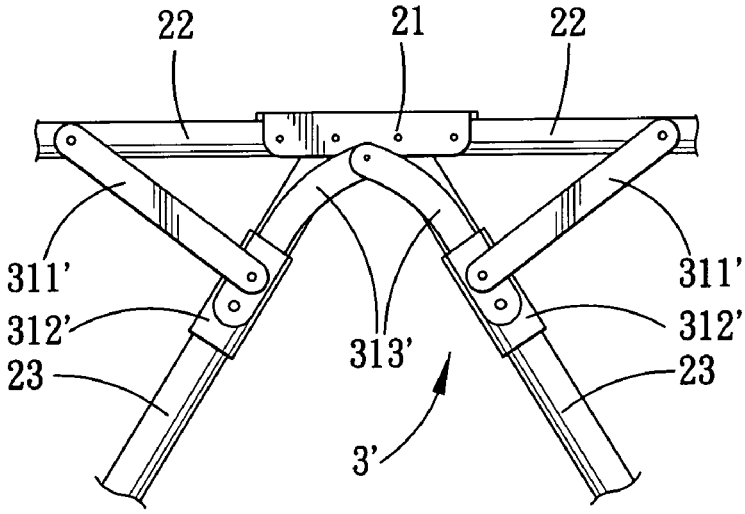
FIG. 6 is a fragmentary enlarged schematic side view to illustrate a modified lateral frame unit of the first preferred embodiment in an expanded state.
Figure 7:
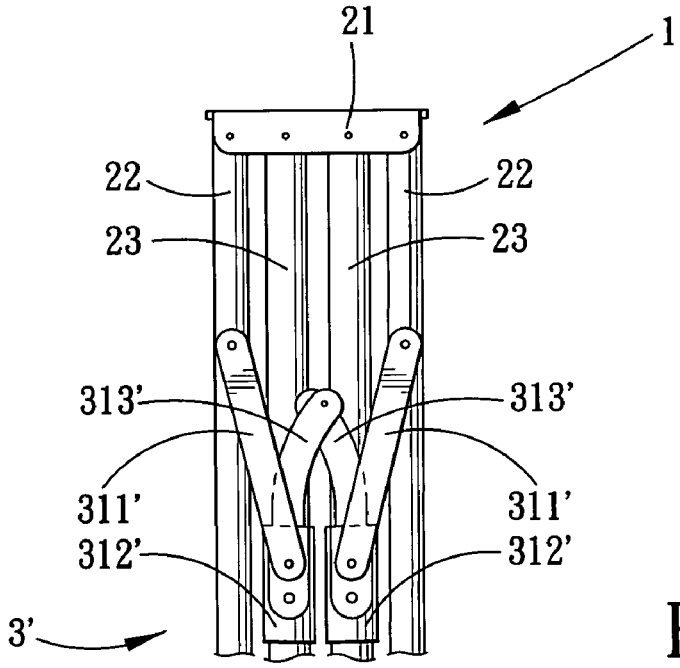
FIG. 7 is a fragmentary enlarged schematic side view to illustrate the modified lateral frame unit of FIG. 6 in a folded state.

FIGS. 6 and 7 illustrate a modified lateral frame unit of the first preferred embodiment. Unlike the lateral frame units shown in FIGS. 1 to 5, the coupling part of each folding member 3' includes a pair of coupling links 311', each of which has a first link end connected pivotally to a respective one of the top rods 22, and a second link end connected pivotally to a respective one of the movable parts 312'. The coupling part of each folding member 3' further includes a pair of elongate connecting links 313' that have first and second link ends and that are disposed between the coupling links 311'. The second link ends of the connecting links 313' are connected respectively to the movable parts 312'. The first link ends of the connecting links 313' extend toward the pivot connection seat 21 and are pivoted to each other such that the connecting links 313' form an inverted V-shaped configuration.

When converting the baby crib 1 to the folded state, movement of the support rods 23 connected to the same pivot connection seat 21 close together results in downward sliding movement of the movable parts 312' on the support rods 23, in folding of the connecting links 313' toward each other, and in downward folding movement of the top rods 22 via the coupling links 311'.

Figure 8:
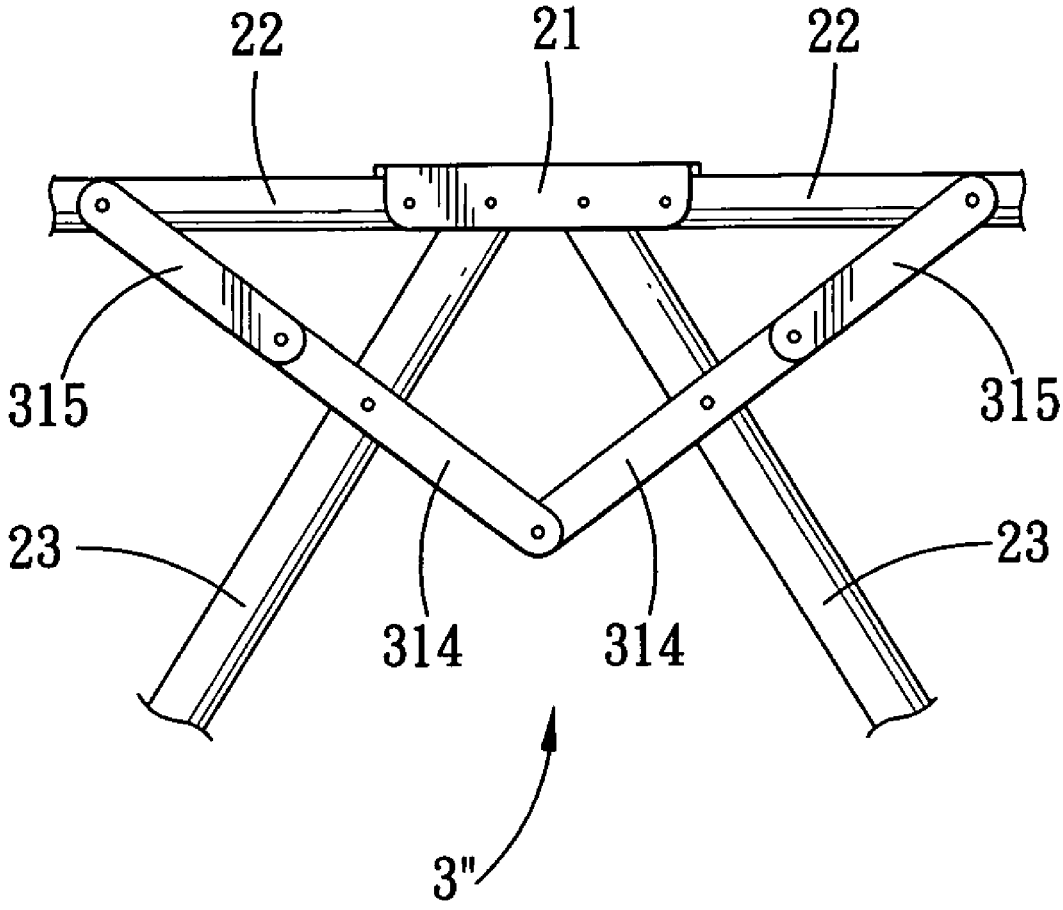
FIG. 8 is a fragmentary enlarged schematic side view to illustrate another modified lateral frame unit of the first preferred embodiment in an expanded state.
Figure 9:
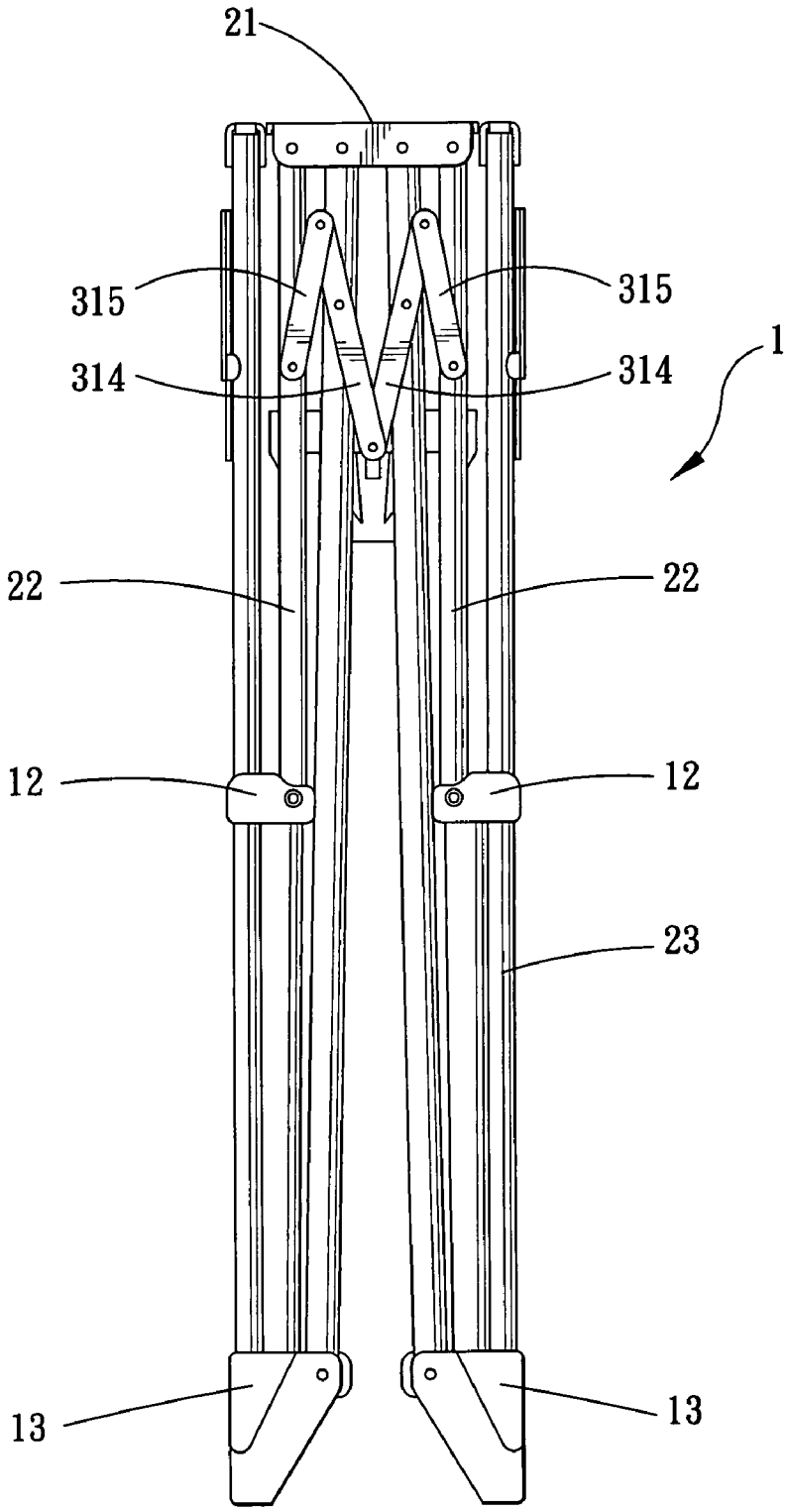
FIG. 9 is a schematic side view to illustrate the modified lateral frame unit of FIG. 8 in the folded state.

FIG. 8 shows another modified lateral frame unit of the first preferred embodiment. Unlike the lateral frame units shown in FIGS. 1 to 5, each folding member 3" includes a pair of first coupling links 314 and a pair of second coupling links 315. The first coupling links 314 are pivoted respectively to the support rods 23, and have second link ends pivoted to each other and first link ends opposite to the second link ends. The second coupling links 315 have second link ends pivoted respectively to the first link ends of the first coupling links 314, and first link ends pivoted respectively to the top rods 22 proximate to the pivot connection seat 21. When the baby crib is in the expanded state, the first and second coupling links 314, 315 cooperate to form a V-shaped configuration. When converting the baby crib to the folded state, the first coupling links 314 pivot toward each other due to movement of the support rods 23 toward each other, and each of the second coupling links 315 pivots downwardly relative to the adjacent first coupling link 314. As best shown in FIG. 9, each pivotally interconnected pair of the first and second coupling links 314, 315 forms an inverted V-shaped configuration when the baby crib 1 is in the folded state.

Figure 10:
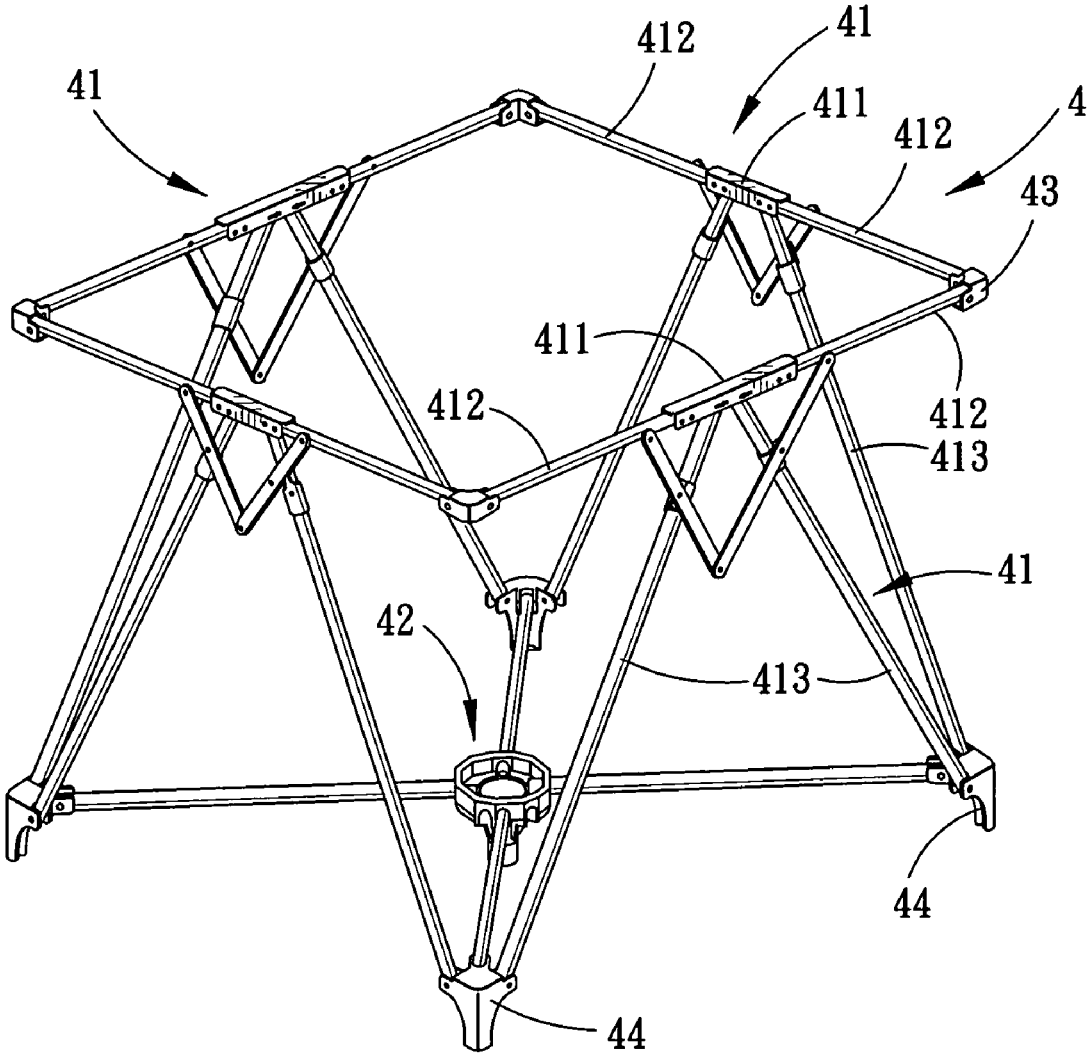
FIG. 10 is a perspective view of the second preferred embodiment of a foldable baby crib according to the present invention.
Figure 11:
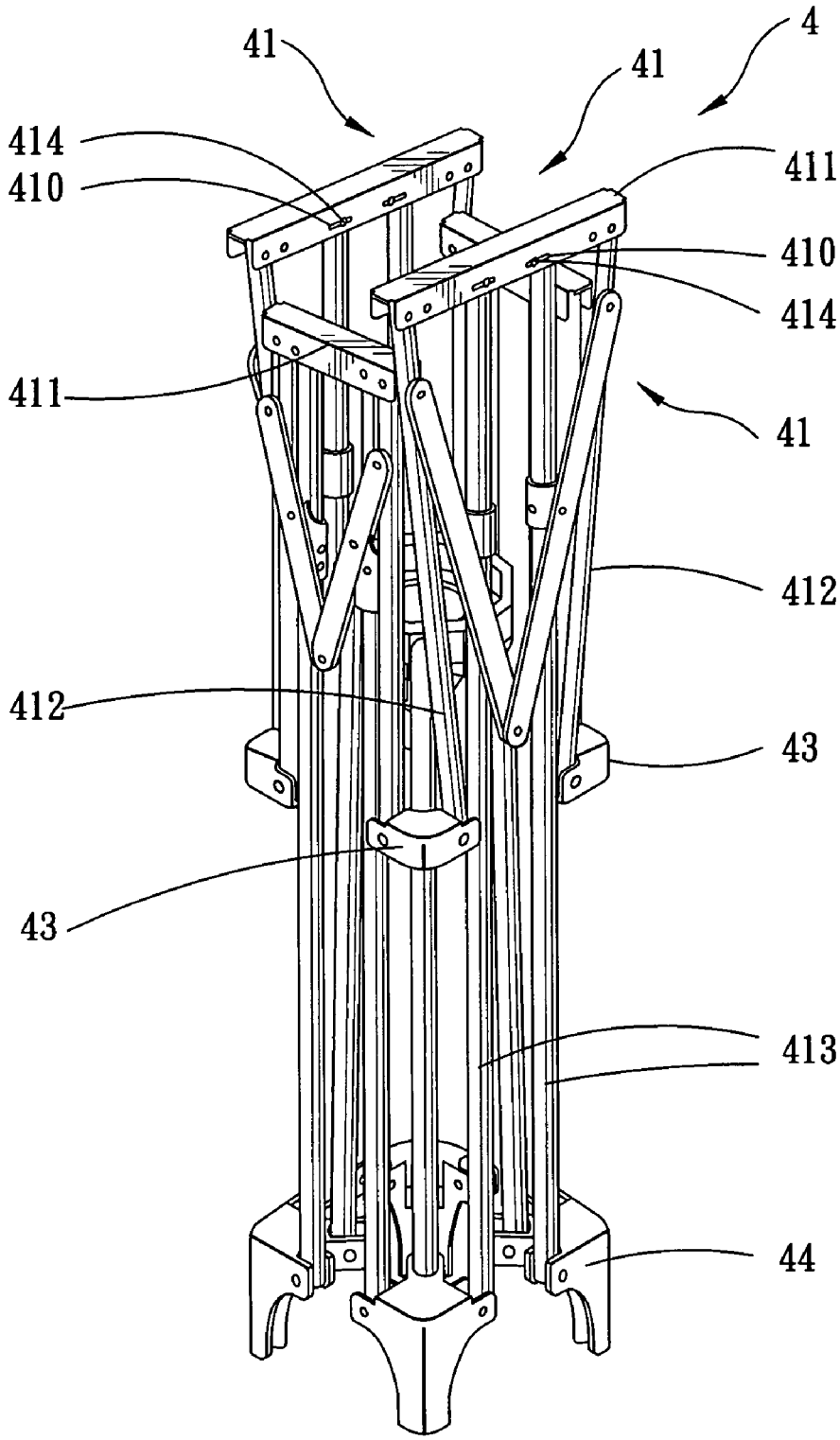
FIG. 11 is a perspective view of the second preferred embodiment in the folded state.

Referring to FIGS. 10 and 11, the second preferred embodiment of a foldable baby crib 4 according to the present invention is shown to include four lateral frame units 41, a bottom frame unit 42, four upper pivot connectors 43, and four lower pivot connectors 44. Each lateral frame unit 41 includes a pivot connection seat 411, a pair of support rods 413, and a pair of top rods 412. Unlike the first preferred embodiment, where the top rods 22 have equal lengths so that the top rods 22 cooperate to form a square-shaped looped frame when the baby crib 1 is in the expanded state, the top rods 412 and the support rods 413 of an opposing pair of the lateral frame units 41 are longer than those of the other opposing pair of the lateral frame units 41. Therefore, when the baby crib 4 is in the expanded state, the top rods 412 cooperate to form a rectangular looped frame, and the baby crib 4 has a rectangular configuration. Moreover, when the baby crib 4 is in the folded state, the baby crib 4 still forms a quadrilateral column configuration, and the pivot connection seats 411 of one of the opposing pairs of the lateral frame units 41 are disposed higher than those of the other opposing pair of the lateral frame units 41.

In this embodiment, the pivot connection seats 411 of the opposing pair of the lateral frame units 41 having the longer top rods 412 and the longer support rods 413 are each formed with a pair of horizontal slots 410. The top rod end of each of the support rods 413 in the opposing pair of the lateral frame units 41 is pivoted to the pivot connection seat 411 by a respective pivot pin 414 extending through and movable in a respective one of the slots 410. The connection as such permits the top rods 412 and the support rods 413 of all of the lateral frame units 41 to be disposed close to each other when the baby crib 4 is in the folded state in spite of the non-uniform lengths of the top rods 412 and the support rods 413 of the lateral frame units 41.

Figure 12:
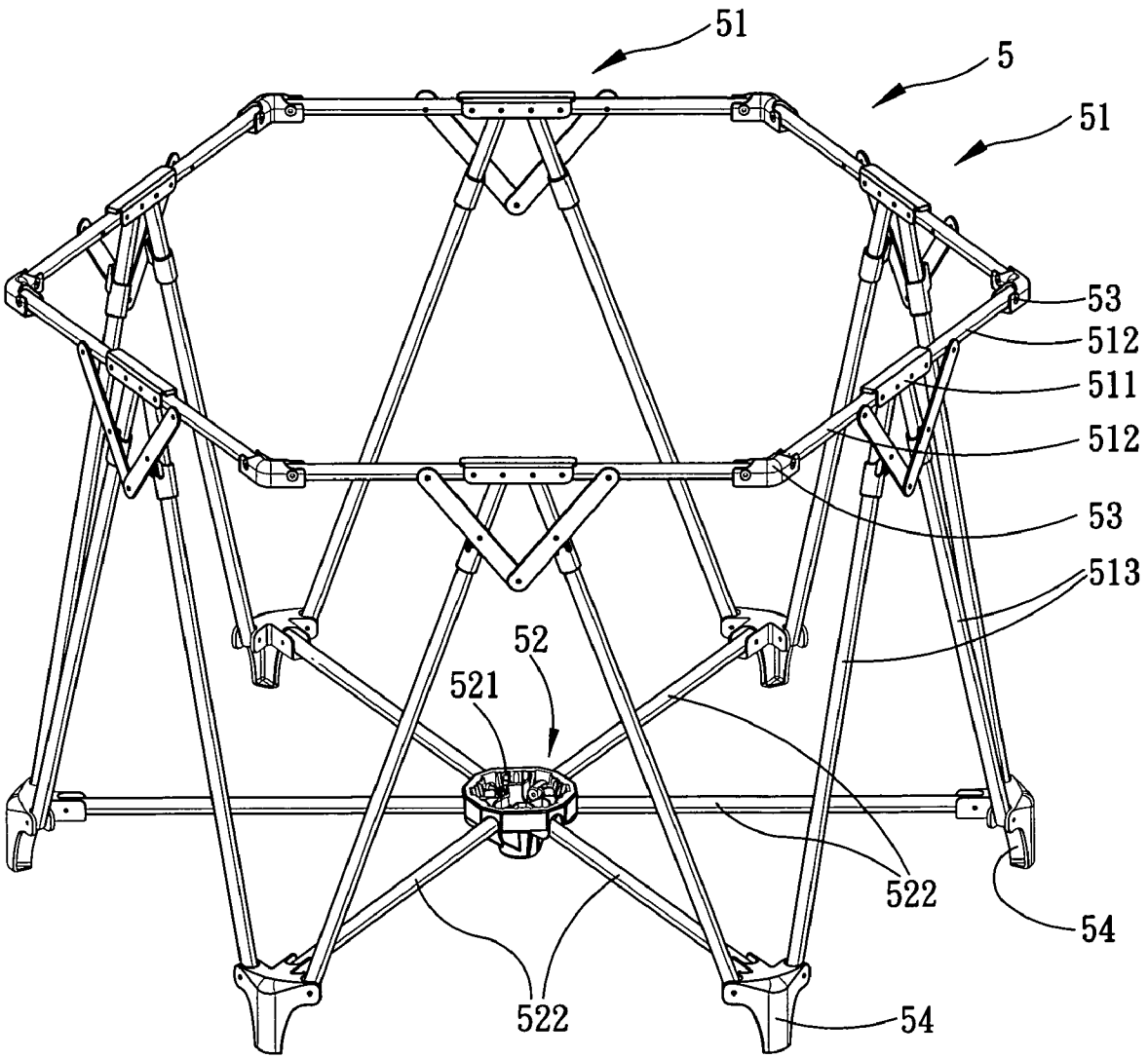
FIG. 12 is a perspective view of the third preferred embodiment of a foldable baby crib according to the present invention.
Figure 13:
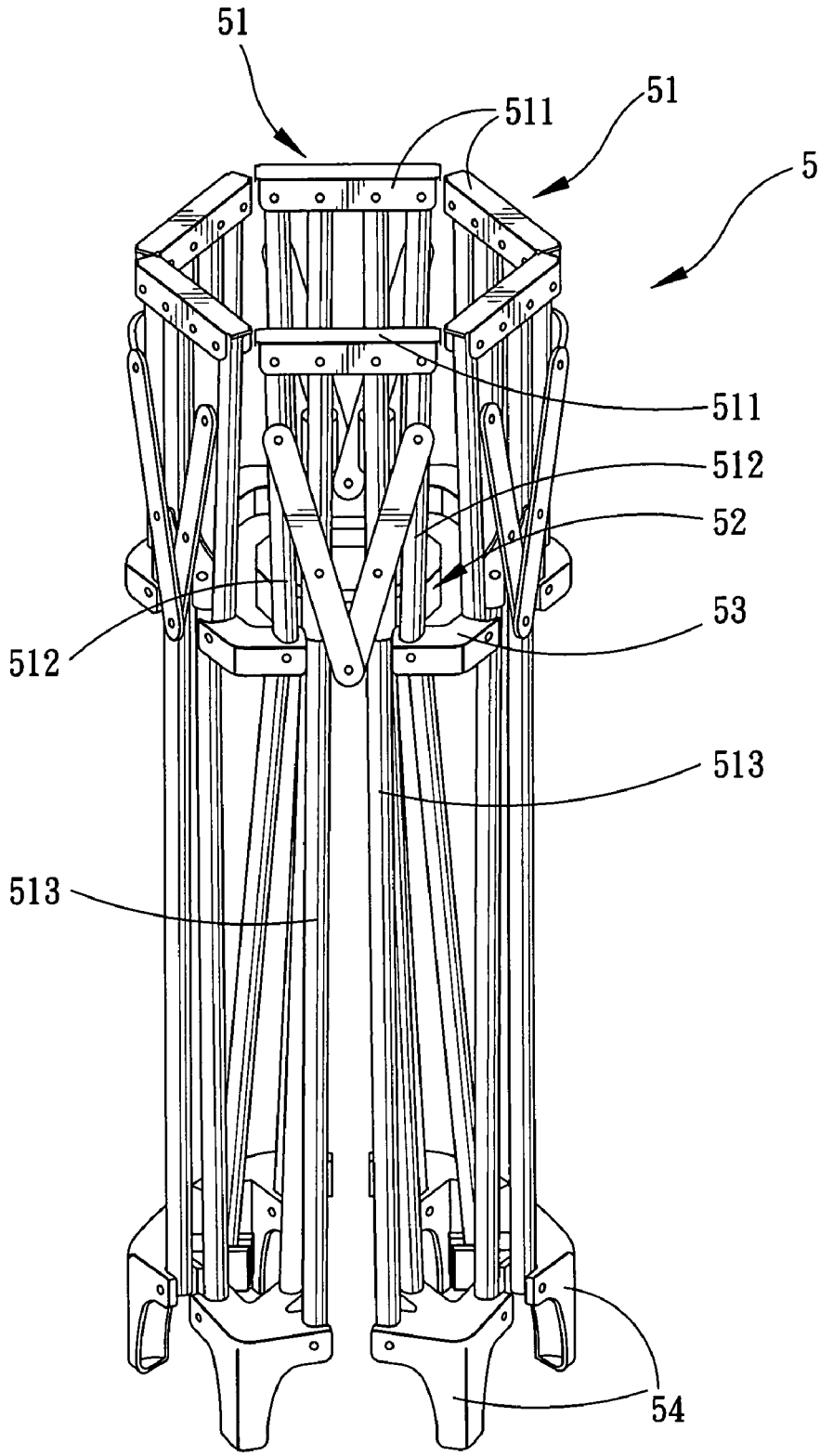
FIG. 13 is a perspective view of the third preferred embodiment in the folded state.

Referring to FIGS. 12 and 13, the third preferred embodiment of a foldable baby crib 5 according to the present invention is shown to differ from the first and second preferred embodiments in the number of sides thereof. In the first and second preferred embodiments, the baby crib 1, 4 has four lateral frame units 11, 41 that result in either a square-shaped configuration or a rectangular configuration when in the expanded state. In this embodiment, the baby crib 5 has a hexagonal configuration when in the expanded state. The baby crib includes six lateral frame units 51, a bottom frame unit 52, six upper pivot connectors 53, and six lower pivot connectors 54. Like the first and second preferred embodiments, each lateral frame unit 51 includes a pivot connection seat 511, and a pair of support rods 513 and a pair of top rods 512 connected to the pivot connection seat 511 and to the upper pivot connectors 53 and the lower pivot connectors 54 in a manner similar to that described hereinabove in connection with the lateral frame units 11, 41. The bottom frame unit 52 includes a hub 521 and six connecting sections 522 connected pivotally and respectively to the lower pivot connectors 54. Since the operations for converting the baby crib 5 between the folded and expanded states are similar to those of the first and second preferred embodiments, further details of the same are omitted herein for the sake of brevity. It is noted that the baby crib 5 of this embodiment has a hexagonal column configuration when in the folded state.

Figure 14:
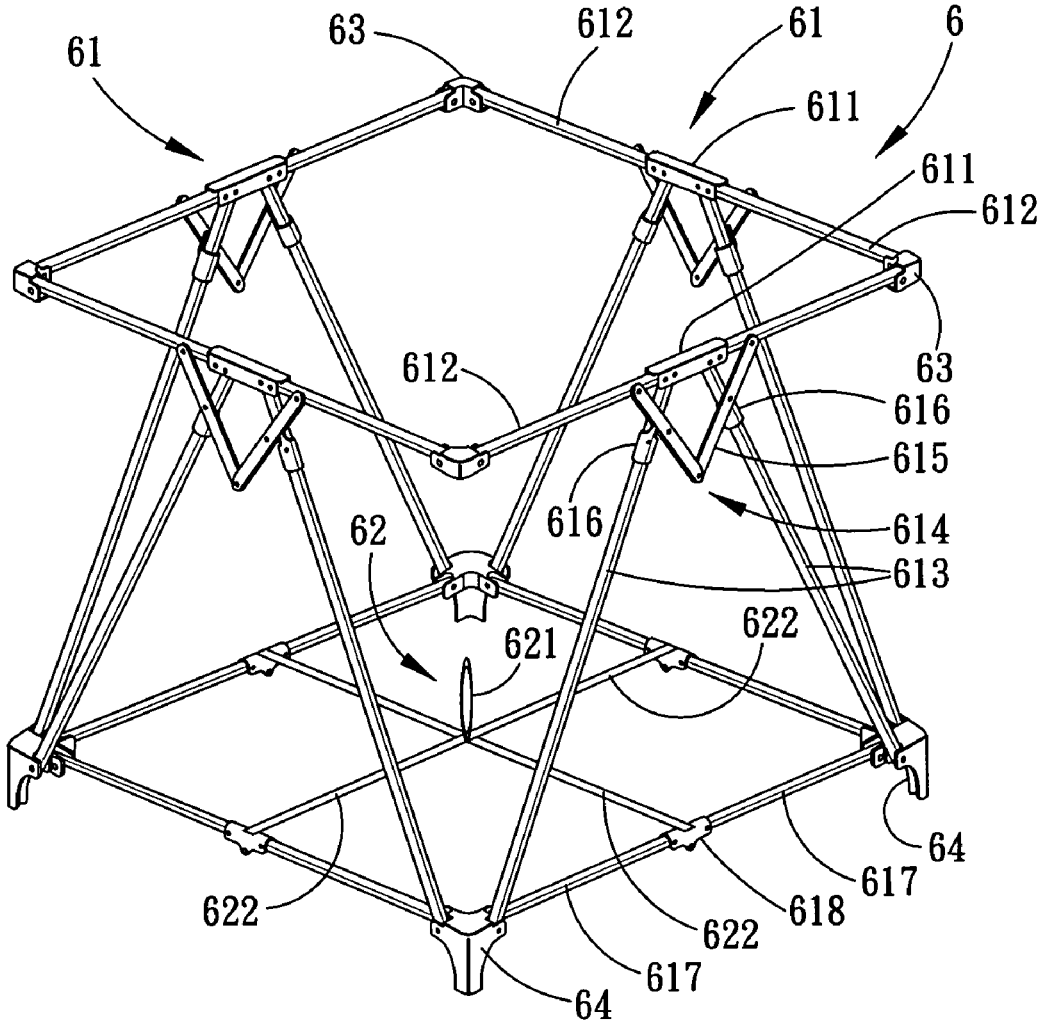
FIG. 14 is a perspective view of the fourth preferred embodiment of a foldable baby crib according to the present invention.
Figure 15:
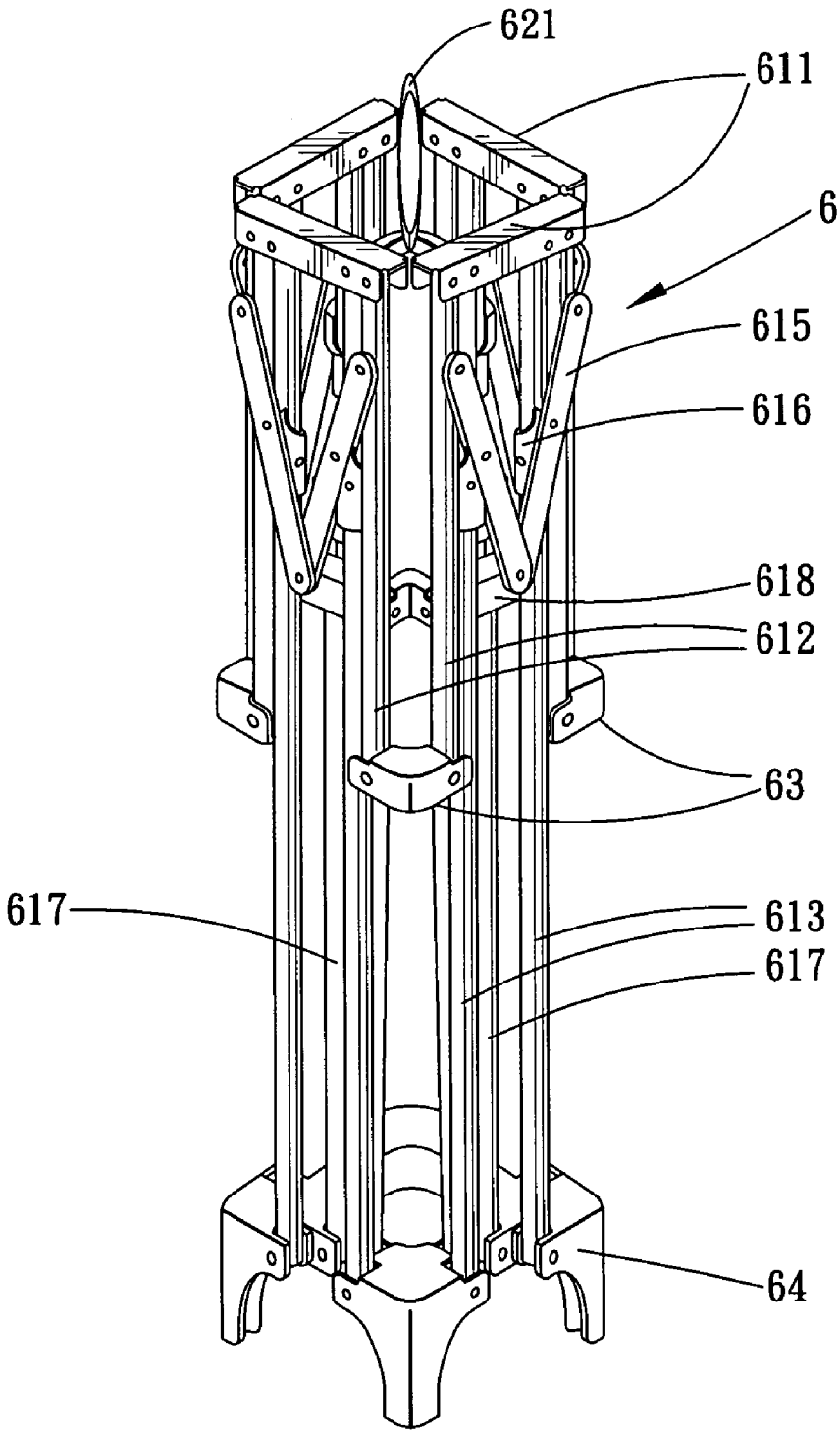
FIG. 15 is a perspective view of the fourth preferred embodiment in the folded state.

Referring to FIGS. 14 and 15, the fourth preferred embodiment of a foldable baby crib 6 according to the present invention is shown to comprise four lateral frame units 61, an actuator 62, four upper pivot connectors 63, and four lower pivot connectors 64.

In this embodiment, each lateral frame unit 61 includes a pivot connection seat 611, a pair of support rods 613, a pair of top rods 612, and a folding member 614. Each support rod 613 has a top rod end pivoted to the pivot connection seat 611, and an opposite lower rod end. Each top rod 612 has an inner rod end and an opposite outer rod end. The inner rod ends of the top rods 612 are pivoted to the pivot connection seat 611 at outer sides of the support rods 613, respectively. In this embodiment, the folding member 614 includes a coupling part 615 pivoted to the top rods 612, and a pair of movable parts 616, each of which is connected pivotally to the coupling part 615 and is mounted slidingly on a respective one of the support rods 613. Each upper pivot connector 63 interconnects pivotally the outer rod ends of the top rods 612 of an adjacent pair of the lateral frame units 61. Each lower pivot connector 64 interconnects pivotally the lower rod ends of the support rods 613 of an adjacent pair of the lateral frame units 61.

Since the lateral frame units 61 are similar to those of the first preferred embodiment in construction, further details of the same are omitted herein for the sake of brevity. It should be noted that the folding member 614 of this embodiment may also be modified to take the form of the folding member 3' or 3" shown in FIGS. 6 to 9. Moreover, the top rods 612 and the support rods 613 of an opposing pair of the lateral frame units 61 may be made longer than those of the other opposing pair of the lateral frame units 61. In this case, the longer support rods 613 may be articulated to the corresponding pivot connection seats 611 using the pin-and-slot connection shown in FIGS. 10 and 11.

Unlike the previous embodiments, a rod connector 618 and a pair of bottom rods 617 are further included in the lateral frame unit 61 of this embodiment. Each of the bottom rods 617 has an inner rod end and an opposite outer rod end. The inner rod ends of the bottom rods 617 are pivoted to the rod connector 618. Each lower pivot connector 64 further interconnects pivotally the outer rod ends of the bottom rods 617 of the adjacent pair of the lateral frame units 61. Preferably, the outer rod ends of the bottom rods 617 are pivoted the lower pivot connectors 64 at rear sides of the lower rod ends of the support rods 613.

In this embodiment, the actuator 62 includes four connecting sections 622, each of which has an inner end and an opposite outer end connected to the rod connector 618 of a respective one of the lateral frame units 61, and a pull member 621 connected to the inner ends of the connecting sections 622. In this embodiment, each of the connecting sections 622 takes the form of a fabric strip, and the pull member 621 is in the form of a pull ring. In practice, the connecting sections 622 may be in the form of rods in other embodiments of this invention.

When the baby crib 6 is in the expanded state, the support rods 613 of each of the lateral frame units 61 form an inverted V-shaped configuration, the top rods 612 of the lateral frame units 61 cooperate to form an upper looped frame, and the bottom rods 617 of the lateral frame units 61 cooperate to form a lower looped frame.

To convert the baby crib 6 to the folded state, the pull member 621 is pulled upward, thereby moving the rod connectors 618 upward via the connecting sections 622. This results in folding of the bottom rods 617 of each of the lateral frame units 61 toward each other and in movement of the lower pivot connectors 64 and the lower rod ends of the support rods 613 toward each other. As the distance between adjacent ones of the lower pivot connectors 64 decreases, the angle between the support rods 613 connected to the same pivot connection seat 611 is reduced, thereby resulting in downward sliding movement of the movable parts 616 of the folding member 614 on the support rods 613 and in downward folding movement of the top rods 612 of the lateral frame units 61 relative to the respective pivot connection seat 611 via the coupling part 615.

As shown in FIG. 15, the top rods 612, the support rods 613, and the bottom rods 617 are parallel to each other and are disposed close to each other when the baby crib 6 is disposed in the folded state. In the folded state, the baby crib 6 has a quadrilateral column configuration, and the bottom rods 617 are disposed rearwardly with respect to the support rods 613.

It has thus been shown that the foldable baby crib 1, 4, 5, 6 of this invention can be easily folded through a single-handed lifting action on the hub 141 or pull member 621. Moreover, since the rod components of the lateral frame units 11, 41, 51, 61 are simultaneously collapsed toward each other such that they are parallel to each other and are close to each other upon folding, the foldable baby crib 1, 4, 5, 6 of this invention has a relatively small size when in the folded state to save space and facilitate storage and transport.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A foldable baby crib comprising:

a bottom frame unit;

a plurality of lateral frame units, each including:

a pivot connection seat, a pair of support rods, each of which has a top rod end pivoted to said pivot connection seat, and an opposite lower rod end, and a pair of top rods, each of which has an inner rod end pivoted to said pivot connection seat, and an opposite outer rod end;

a plurality of upper pivot connectors, each of which interconnects pivotally said outer rod ends of said top rods of an adjacent pair of said lateral frame units;

a plurality of lower pivot connectors, each of which interconnects pivotally said lower rod ends of said support rods of an adjacent pair of said lateral frame units, and is connected pivotally to said bottom frame unit;

said bottom frame unit being operable to convert said foldable baby crib between an expanded state, where said bottom frame unit and said lateral frame units cooperate to define a crib space, and a folded state, where said bottom frame unit and said lateral frame units are collapsed; and wherein said bottom frame unit includes a hub and a plurality of connecting sections, each having an inner end connected to said hub, and an opposite outer end connected pivotally to a respective one of said lower pivot connectors.

2. The foldable baby crib as claimed in claim 1, wherein each of said lateral frame units further includes a folding member, said folding member including a coupling part pivoted to said top rods, and a pair of movable parts, each of which is connected pivotally to said coupling part and is mounted slidingly on a respective one of said support rods.

3. The foldable baby crib as claimed in claim 2, wherein said coupling part includes a pair of coupling links, each of which has first and second link ends, said second link ends of said coupling links being pivoted to each other, said first link ends of said coupling links being connected pivotally and respectively to said top rods.

4. The foldable baby crib as claimed in claim 3, wherein each of said movable parts is pivoted to a respective one of said coupling links between said first and second link ends.

5. The foldable baby crib as claimed in claim 2, wherein said coupling part includes a pair of coupling links, each of which has a first link end connected pivotally to a respective one of said top rods, and a second link end connected pivotally to a respective one of said movable parts, said coupling part further including a pair of connecting links that have first and second link ends, said second link ends of said connecting links being connected respectively to said movable parts, said first link ends of said connecting links being pivoted to each other such that said connecting links form an inverted V-shaped configuration.

6. The foldable baby crib as claimed in claim 2, wherein each of said movable parts is tubular and is sleeved on the respective one of said support rods.

7. The foldable baby crib as claimed in claim 1, wherein each of said lateral frame units further includes a folding member, said folding member including a pair of first coupling links and a pair of second coupling links, said first coupling links being pivoted respectively to said support rods and having second link ends pivoted to each other and first link ends opposite to said second link ends, said second coupling links having second link ends pivoted respectively to said first link ends of said first coupling links, and first link ends pivoted respectively to said top rods.

8. The foldable baby crib as claimed in claim 1, wherein:

said support rods of each of said lateral frame units form an inverted-V shaped configuration, and said top rods of said lateral frame units cooperate to form a looped frame when said foldable baby crib is disposed in the expanded state;

said top rods and said support rods of said lateral frame units being parallel to each other and being disposed close to each other when said foldable baby crib is disposed in the folded state.

9. The foldable baby crib as claimed in claim 1, wherein said pivot connection seats of an opposing pair of said lateral frame units are each formed with a pair of horizontal slots, said top rod end of each of said support rods in said opposing pair being pivoted to said pivot connection seat by a respective pivot pin extending through and movable in a respective one of said slots.

10. A baby crib convertible between an expanded state and a folded state, comprising a plurality of lateral frame units, each forming a side of said baby crib when said baby crib is in the expanded state, and each including a pivot connection seat, a pair of support rods, each of which has a top rod end pivoted to said pivot connection seat, and an opposite lower rod end, and a pair of top rods, each of which has an inner rod end pivoted to said pivot connection seat and an opposite outer rod end, wherein said support rods of each of said lateral frame units form an inverted V-shaped configuration when said baby crib is in the expanded state, wherein said lower rod ends of said support rods of each of said lateral frame units are close to each other, and said top rods of each of said lateral frame units are pivoted relative to said pivot connection seat when said baby crib is converted from the expanded state to the folded state;

a plurality of lower pivot connectors, each of which interconnects pivotally said lower rod ends of said support rods of an adjacent pair of said lateral frame units;

a bottom frame unit including a hub and a plurality of connecting sections, each having an inner end connected to said hub, and an opposite outer end connected pivotally to a respective one of said lower pivot connectors, and wherein said hub is lifted upward to move said lower rod ends of said support rods of said lateral frame units close to each other when converting said baby crib from the expanded state to the folded state.

11. The baby crib as claimed in claim 10, further comprising:

a plurality of upper pivot connectors, each of which interconnects pivotally said outer rod ends of said top rods of an adjacent pair of said lateral frame units.

12. The baby crib as claimed in claim 10, wherein each of said lateral frame units further includes a folding member for linking said top rods to said support rods such that movement of said support rods is transmitted simultaneously to said top rods by said folding member when said baby crib is converted between the expanded state and the folded state.

13. A baby crib convertible between an expanded state and a folded state, comprising a plurality of lateral frame units, each forming a side of said baby crib when said baby crib is in the expanded state, and each including a pivot connection seat, a pair of support rods, each of which has a top rod end pivoted to said pivot connection seat, and an opposite lower rod end, and a pair of top rods, each of which has an inner rod end pivoted to said pivot connection seat and an opposite outer rod end, wherein said support rods of each of said lateral frame units form an inverted V-shaped configuration when said baby crib is in the expanded state, wherein said lower rod ends of said support rods of each of said lateral frame units are close to each other, and said top rods of each of said lateral frame units are pivoted relative to said pivot connection seat when said baby crib is converted from the expanded state to the folded state;

a plurality of lower pivot connectors, each of which interconnects pivotally said lower rod ends of said support rods of an adiacent pair of said lateral frame units;

a bottom frame unit including a hub and a plurality of connecting sections, each having an inner end connected to said hub, and an opposite outer end connected pivotally to a respective one of said lower pivot connectors, and wherein said baby crib is converted from the expanded state to the folded state through a single action by moving said hub upward.

14. The baby crib as claimed in claim 13, further comprising:

a plurality of upper pivot connectors, each of which interconnects pivotally said outer rod ends of said top rods of an adjacent pair of said lateral frame units.

15. The baby crib as claimed in claim 13, wherein each of said lateral frame units further includes a folding member for linking said top rods to said support rods such that movement of said support rods is transmitted simultaneously to said top rods by said folding member when said baby crib is converted between the expanded state and the folded state.

* * * * *